United States Patent [19]

Roetter et al.

[11] Patent Number: 4,635,922

[45] Date of Patent: Jan. 13, 1987

[54] ENVELOPE FEEDING APPARATUS

[75] Inventors: Frank Roetter, Westport; Frank Oeschger, Norwalk, both of Conn.

[73] Assignee: Pitney Bowes Inc., Stamford, Conn.

[21] Appl. No.: 665,870

[22] Filed: Oct. 29, 1984

[51] Int. Cl.[4] ..... B65H 3/06

[52] U.S. Cl. ..... 271/119; 221/259; 221/277; 271/121; 271/126; 271/149

[58] Field of Search ..... 271/126, 149, 150, 10, 271/121, 122, 124, 125, 119, 120, 37, 38, 167; 221/231, 259, 260, 277

[56] References Cited

U.S. PATENT DOCUMENTS

| | | | |
|---|---|---|---|
| 2,080,968 | 5/1937 | Krell | 271/124 |
| 2,195,576 | 4/1940 | Metzger | 271/124 |
| 4,030,723 | 6/1977 | Irvine et al. | 271/121 |
| 4,039,180 | 10/1977 | Stocker | 271/149 X |
| 4,039,181 | 10/1977 | Prewer | 271/149 X |

FOREIGN PATENT DOCUMENTS

| | | | |
|---|---|---|---|
| 168069 | 9/1922 | United Kingdom | 271/38 |

*Primary Examiner*—John J. Love
*Assistant Examiner*—John A. Carroll
*Attorney, Agent, or Firm*—Lawrence E. Sklar; Melvin J. Scolnick; David E. Pitchenik

[57] ABSTRACT

An envelope feeding apparatus, including a hopper having a support deck and a pair of vertical sides extending upwardly from the support deck, the support deck being oriented at an acute angle with respect to a horizontal plane, a separator roller and a separator stone situated at the lower end of the hopper for feeding envelopes seriatim from the hopper, a center ramp located upstream of the separator roller and the separator stone, the center ramp extending only a small portion of the distance between the vertical sides of the hopper, a center feed roller located above the downstream portion of the center ramp and proximate the separator stone, whereby the lower corners of the envelopes are raised off the support deck when the envelopes are translated along the center ramp and under the feed roller, thereby allowing the envelopes to approach the separator roller and the separator stone unskewed.

4 Claims, 3 Drawing Figures

ENVELOPE FEEDING APPARATUS

The instant invention relates to envelope feeding apparatus, and more particularly to apparatus for preventing twisting and skewing of envelopes in a device feeding envelopes seriatim from a hopper.

Inserting machines typically include a plurality of feeding devices which feed documents from a pack of documents situated in a hopper seriatim to a transport deck therebelow, from which a collated packet of documents are eventually inserted into an envelope. The envelopes are fed from a hopper seriatim to the transport deck to receive the documents. The envelope feeders employ hoppers that generally are inclined at a fixed angle which usually is somewhere between about 20 and 30 degrees. The feeder depends on gravity to slide the documents down to and against a separator roller and stone for seriatim feeding.

In using the foregoing feeding device problems have developed when the envelopes being fed are warped or twisted, giving rise to a phenomenon known as propeller twist, which is often due to the effect of moisture or humidity on the glue portion of the envelope flaps and glassive window patch. The feeder hopper include sides guides, but once an envelope becomes skewed, it cannot straighten out and it will exit the roller and stone with the same skew as it had prior to its entry into the roller and stone, causing the envelope to become bent and generating misfeeds and jams, which will require that the feeder be stopped.

The instant invention therefore provides apparatus which will straighten the envelope and remove any skew, whether to the right or left, prior to the envelope's entry into the nip of the separator roller and stone.

SUMMARY OF THE INVENTION

Accordingly, the instant invention comprises an envelope feeding apparatus, including a hopper having a support deck and a pair of vertical sides extending upwardly from said support deck, the support deck being oriented at an acute angle with respect to a horizontal plane, a separator roller and a separator stone situated at the lower end of the hopper for feeding envelopes seriatim from the hopper, and a center ramp located upstream of the separator roller and the separator stone, the center ramp extending only a small portion of the distance between the vertical sides of the hopper. The envelope feeding apparatus also includes a center feed roller located above the downstream portion of the center ramp and proximate the separator roller and the separator stone, whereby the lower corners of the envelopes are raised off the support deck when the envelopes are translated along said center ramp and under said feed roller, thereby allowing the envelopes to approach the separator roller and the separator stone unskewed.

DETAILED DESCRIPTION

Figure 1:
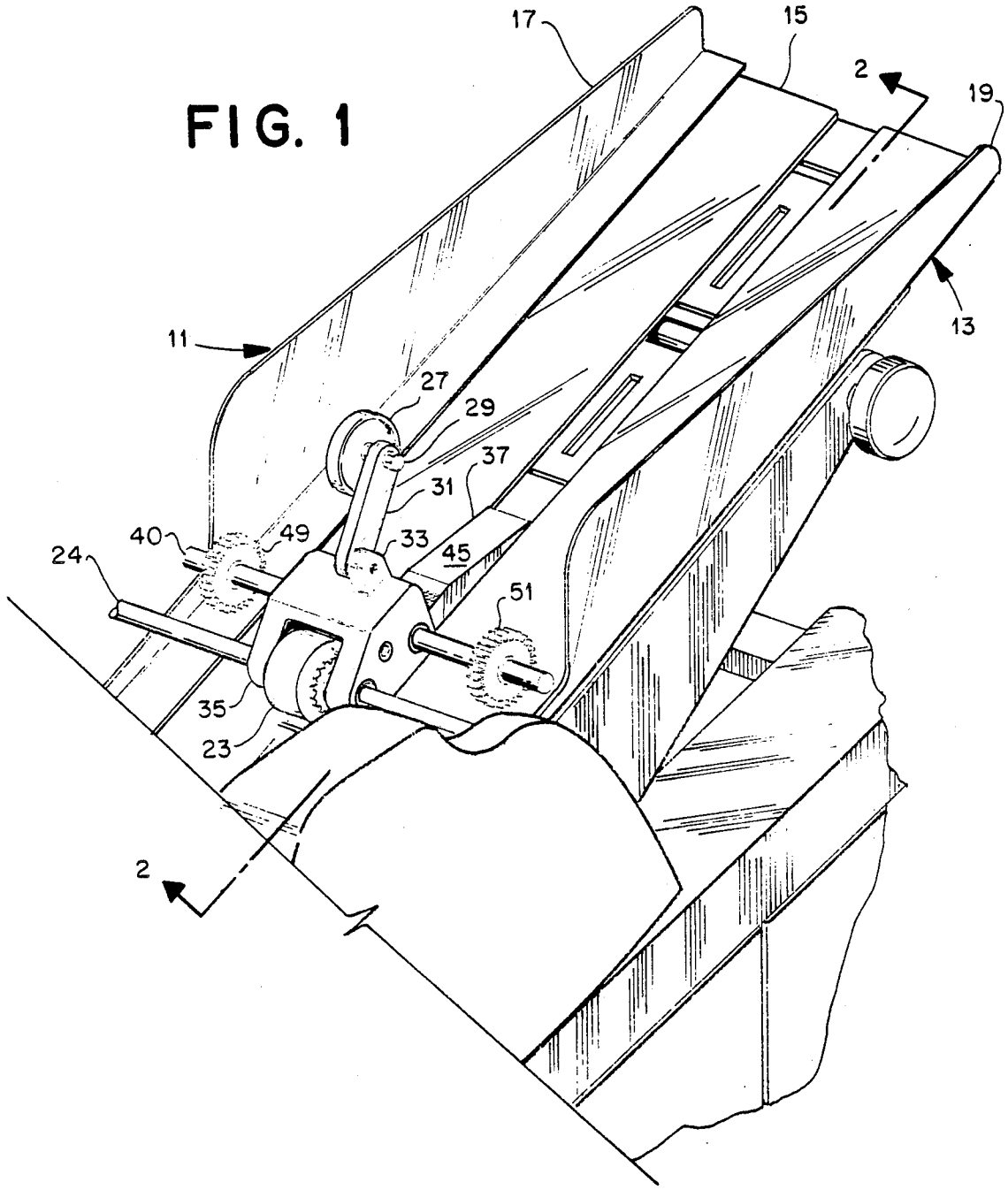
FIG. 1 is a perspective view of an envelope feeding apparatus in accordance with the instant invention.

In describing the preferred embodiment, reference is made to the drawings wherein there is seen an envelope feeder generally designated 11 which may be part of an inserting machine (not shown) which typically includes a series of feeders for feeding documents to be inserted into the envelopes. The feeder 11 includes a hopper 13 having a support deck 15 and a pair of vertical sidewalls 17 and 19 extending from the support deck 15. The hopper 13 is oriented at an acute angle, preferably about 26 degrees, to the horizontal and supports a pack of envelopes 21 (see FIGS. 2 and 3) which are fed seriatim therefrom by means of a separator roller 23 mounted on a shaft 24 and a separator stone 25 located at the lower end of the hopper 13. The angle at which the pack of envelopes 21 rest on the deck 15 is determined by the support wheel 27 which rotates about a shaft 29 seated in an arm 31 which is pivotable about a bushing 33 extending upwardly from a housing 35.

Located upstream of the separator roller 23 and separator stone 25 is a center ramp 37 which extends for only a small portion of the distance between the vertical sidewalls 17 and 19 of the hopper 13. Details of the ramp 37 will be discussed hereinbelow. Located above the downstream portion of the center ramp 37 and proximate the separator roller 23 and separator stone 25 is a center feed roller 39 mounted in a shaft 40. Both the shaft 24 and the shaft 40 are journaled in the housing 35.

Figure 2:
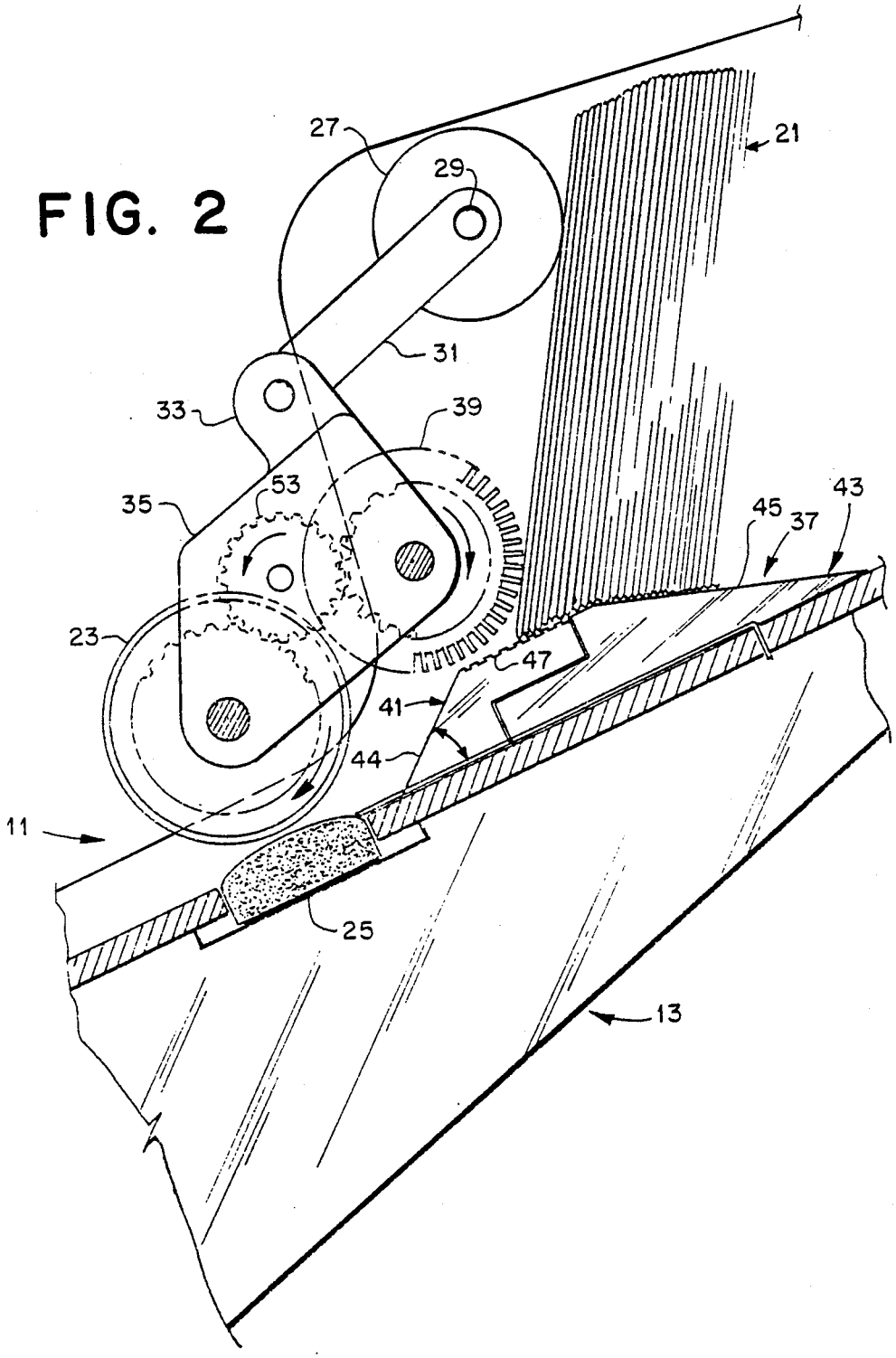
FIG. 2 is a vertical sectional view taken on the plane indicated by the line 2—2 in FIG. 1.
Figure 3:
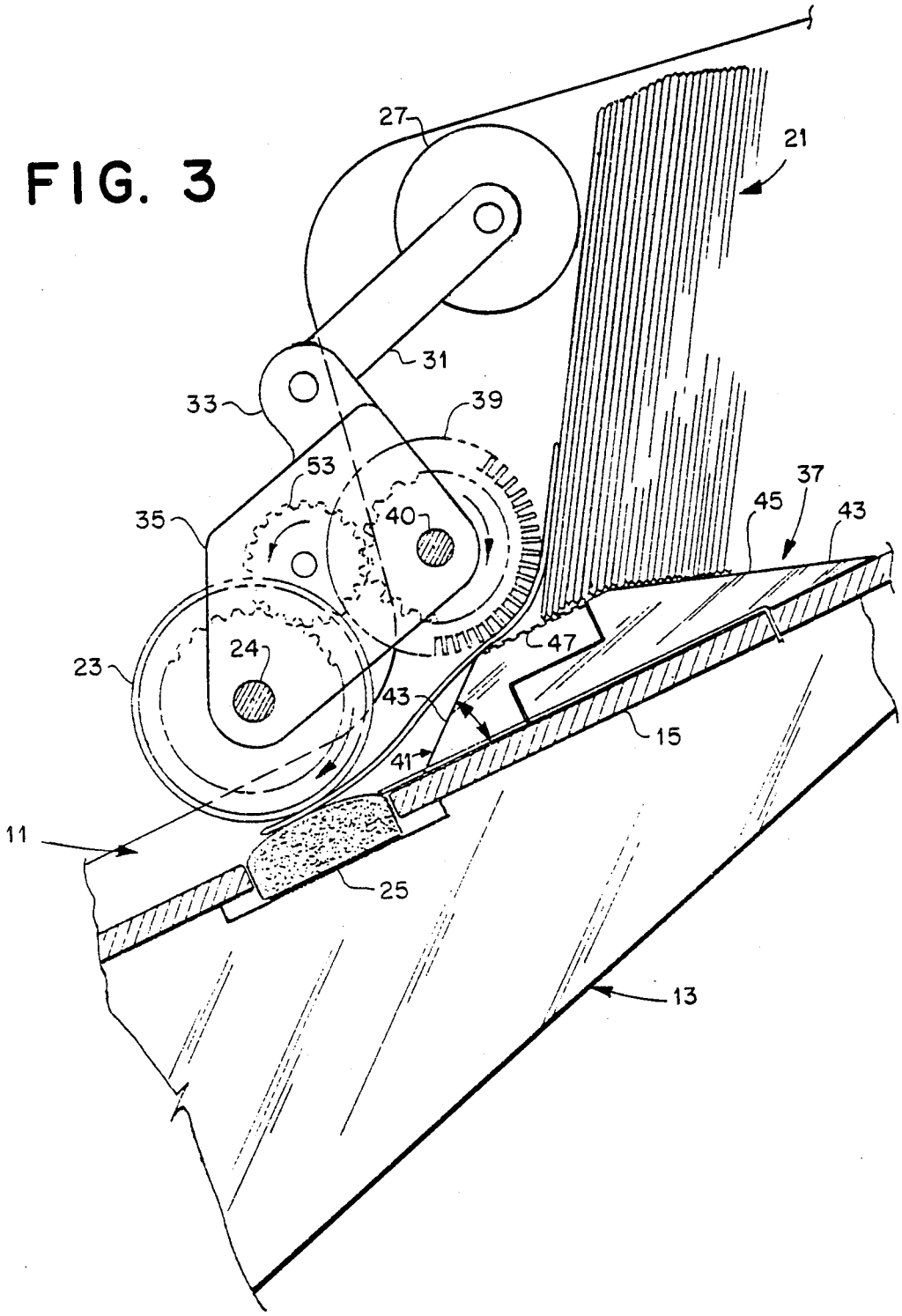
FIG. 3 is the same as FIG. 2 except that it shows an envelope in the course of being separated and fed.

The center ramp 37 comprises a downstream section 41 and an upstream section 43 (see FIGS. 2 and 3). The upstream section 43 comprises an elongated, inclined surface 45 (inclined with respect to the support deck 15) which leads to the knurled surface 47 of the downstream section 41. The angle indicated in FIGS. 2 and 3 between the deck 15 and the angled surface 44 of the downstream section 41 should be about 45 degrees. The knurled surface 47 provides resistance to the envelopes 21 so that they remain properly aligned prior to their being fed by the center feed roller 39. It has been found that the preferred height of the ramp 37 (i.e. the distance from the support deck 15 to the knurled surface 47) is about ½ inch, while the preferred distance between the angled tip of the downstream section 41 and the center of the separator stone 25 is about 1⅛ inches.

At the ends of the shaft 40 are a pair of auxiliary guide rollers 49 and 51 (see FIG. 1) which assist in the feeding of the envelopes 21 to the separator roller 23 and the separator stone 25. In operation, the pack of envelopes 21 are held in proper alignment and at the appropriate angle by the support wheel 27. A gear 53 is driven counter-clockwise which causes the center feed roller 39, the auxiliary guide rollers 49 and 51 and the separator roller 23 to rotate in a clockwise direction. The envelopes 21 are caused to rise above the support deck 15 by the action of the center ramp 37, and because the center ramp does not extend to the vertical sidewalls 17 and 19, the lower corners of the envelopes are not in contact with any lower surface which contact might prevent straight feeding of the envelopes 21. Since the only part of the envelopes 21 being fed through the ramp 37 and feed wheel 39 is the center, the effect of a skewed envelope 21 is eliminated as there is no contact with the lower corners of the envelopes 21. Accordingly, the envelopes 21 are fed straight by the feed wheel 39 to the separator roller 23 and separator stone 25, thereby assuring that the envelopes 21 will emerge from the separtor roller 23 and separator stone 25 straight, thus eliminating the possibility of the envelopes 21 becoming bent and causing misfeeds and/or jams.

The exemplary embodiments described herein are presently considered to be preferred; however, it is contemplated that further variations and modifications within the purview of those skilled in the art can be made herein. The following claims are intended to cover all such variations and modifications as fall within the true spirit and scope of the invention.

What is claimed is:

1. An envelope feeding apparatus, comprising:

a hopper having a support deck and a pair of vertical sides extending upwardly from said support deck, said support deck being oriented at an acute angle with respect to a horizontal plane;

a separator roller and a separator stone situated at the lower end of the hopper for feeding envelopes seriatim from said hopper;

a center ramp located upstream of said separator roller and said separator stone, said center ramp having a downstream and an upstream portion, said upstream portion comprising an elongated surface inclined with respect to the hopper support deck, said downstream portion having a knurled surface parallel to the hopper support deck and adjacent the elongated, inclined surface of said upstream portion, and said center ramp extending only a small portion of the distance between the vertical sides of said hopper; and a center feed roller located above said downstream portion of said center ramp and proximate said separator stone, whereby the lower corners of said envelopes are raised off said support deck when said envelopes are translated along said center ramp and under said feed roller, thereby allowing said envelopes to approach said separator roller and said separator stone unskewed.

2. The apparatus of claim 1, wherein the downstream portion of said center ramp includes an angled surface adjacent said knurled surface, and wherein the angle between said angled surface and said support deck is about 45 degrees.

3. The apparatus of claim 2, wherein the height of said center ramp is about 0.5 inches.

4. The apparatus of claim 3, wherein the distance between the juncture of the angled surface and the support deck and the center of the separator stone is about 1 and $\frac{1}{8}$ inches.

* * * * *